US005691193A

United States Patent [19]

Paice et al.

[11] Patent Number: 5,691,193

[45] Date of Patent: Nov. 25, 1997

[54] NON-CHLORINE BLEACHING OF KRAFT PULP

[75] Inventors: Michael Geoffrey Paice, Pointe Claire; Robert Ernest Bourbonnais, Ville St-Laurent, both of Canada

[73] Assignee: Pulp and Paper Research Institute of Canada, Pointe Claire, Canada

[21] Appl. No.: 264,304

[22] Filed: Jun. 23, 1994

Related U.S. Application Data

[63] Continuation-in-part of Ser. No. 22,299, Feb. 25, 1993, abandoned.

[51] Int. Cl.[6] ..... D21C 3/00

[52] U.S. Cl. ..... 435/278; 435/277; 435/911; 162/1; 162/9; 162/70; 162/71

[58] Field of Search ..... 162/1, 9, 70, 11; 435/192, 277, 278, 911

[56] References Cited

U.S. PATENT DOCUMENTS

| | | | |
|---|---|---|---|
| 4,690,895 | 9/1987 | Farrell | 435/278 |
| 4,830,708 | 5/1989 | Paice et al. | 162/72 |

FOREIGN PATENT DOCUMENTS

| | | |
|---|---|---|
| 1 079 457 | 6/1980 | Canada . |
| 2 019 411 | 6/1990 | Canada . |
| 447673 | 5/1988 | European Pat. Off. . |
| 0345715 | 6/1989 | European Pat. Off. . |
| 408 803 | 9/1989 | European Pat. Off. . |
| 0 496 671 | 1/1992 | European Pat. Off. . |
| 3 636 208 | 10/1986 | Germany . |
| 03190 | 5/1988 | WIPO . |
| WO 92/07998 | 5/1992 | WIPO . |
| WO 92/09741 | 6/1992 | WIPO . |
| WO92/020857 | 11/1992 | WIPO . |
| WO 94/12620 | 6/1994 | WIPO . |

OTHER PUBLICATIONS

Call et al., "Application of Lignolytic Enzymes in the Production of Pulp and Paper". Das Papier 44 Oct. (1990) pp. 32–41.

Lierop et al. "Using Oxygen and Peroxide to Bleach Kraft Pulps" 79th Annual Meeting, Technical Section, CPPA (1992) B81–B99.

Paice et al., Appl. Environment. Microbiol., 59:260–265 (1993).

Vikari et al. "Bleaching with Enzymes" Stockholm, Sweden Jun. 16–19, 1986 Biotechnology in the Pulp & Paper Industry, 3rd Int. Conf. pp. 67–69.

Bourbonnais & Paice "Demethylation & Delignification of Kraft Pulp by Trametes versicolor laccase in the Presence of 2,2–azinobis–(3–ethylbenzthiazoline–6–sulphonate") Appl. Microbiol. Biotechnol. 36:823–827 (1992).

Hammel et al. "Depolymerization of a Synthetic Lignin in vitro by lignin peroxidase" Enzyme Microbial. Technol. 13:15–18 (1991).

(List continued on next page.)

*Primary Examiner*—Donald E. Czaja
*Assistant Examiner*—Lien Tran
*Attorney, Agent, or Firm*—Swabey Ogilvy Renault

[57] ABSTRACT

A process for the bleaching of kraft pulps with non-chlorine chemicals, employing a sequential reaction of oxidative enzymes and hydrogen peroxide. The kraft pulp can be from conventional or extended pulping, or from an oxygen delignification step. The enzyme reaction is monitored by methanol release which results from the demethylation of lignin. The process essentially comprises three steps. The first step is the oxidation of kraft pulp either with manganese peroxidase enzyme in the presence of Mn(II) salts, hydrogen peroxide and chelator, or with laccase enzyme preferably in the presence of 2,2'-azinobis(3-ethylbenzothiazoline-6-sulfonic acid (ABTS), or a combination of both enzymes in a crude mixture as typically produced by certain fungi. The Mn(II) salts and chelator may already be present in sufficient amount in the pulp. This first step is performed at an acidic pH, and moderate temperatures for a period of time between 30 and 240 minutes. The two subsequent steps are the chelation of metals in the pulp and the alkaline hydrogen peroxide treatment.

4 Claims, 1 Drawing Sheet

OTHER PUBLICATIONS

Wariishi et al. "In vitro depolymerization of Lignin by Manganese Peroxidase of Phanerochaete chrysosporium" Biochem. Biophys. Res. Commun. 176:269–275 Apr. 15, 1991.

Arbeloa et al. "An Evaluation of the Potential of Lignin Peroxidases to Improve Pulps" Tappi J. 75(3):215–221 (1992).

Reid & Paice "Biological Bleaching of kraft Pulp: A Review" in Frontiers in Industrial Mycology /G.F. Leatham, ed.) pp. 112–116 (1992).

NON-CHLORINE BLEACHING OF KRAFT PULP

RELATED APPLICATIONS

This application is a continuation-in-part of application Ser. No. 08/022,299 filed on Feb. 25, 1993 now abandon.

BACKGROUND OF THE INVENTION (a) Field of the Invention

The invention relates to a process for the bleaching of lignocellulosic kraft pulps, and especially to a process which involves non-chlorine chemicals.

(b) Description of Prior Art

Pulp manufactured by the kraft process must be bleached to provide the white product used in fine paper, tissue and the like. Traditionally, the bleaching of pulp has been effected through sequential reactions involving chlorine and sodium hydroxide. More recently, chlorine dioxide has been increasingly substituted for chlorine. Due to environmental concerns over chloroorganic compounds present in the bleaching effluents, non-chlorine bleaching reactions are currently being introduced. These include oxygen delignification followed by chelation and hydrogen peroxide oxidation (e.g. the Lignox™ process), and combinations of ozone and other non-chlorine compounds. These processes are presently more costly and less selective for lignin than chlorine bleaching.

The use of enzymes in bleaching was first reported in 1986 by Viikari et al. (*Proceedings Biotechnol. Pulp Paper Industry*, Stockholm: 67–69). The xylanase enzyme was found to facilitate subsequent bleaching by chlorine, chlorine dioxide, and hydrogen peroxide. Since 1986, many articles and patent applications have been published in the field of xylanase bleaching, as reviewed by Reid and Paice (*Frontiers in Industrial Mycology*, G. F. Leatham Ed., Chapman-Hall, pgs. 112–116 (1992)). Xylanases are hydrolytic enzymes which act on xylan in unbleached kraft pulp. Other enzymes are known to act on lignin, especially oxidative enzymes such as laccase (Bourbonnais and Paice, *Appl. Microbiol. Biotechnol.*, 36:823–827 (1992)), lignin peroxidase (Hammel and Moen, *Enzyme Microbial. Technol.*, 13:15–18 (1991)) and manganese peroxidase (Paice et al., *Appl. Environment. Microbiol.*, 59:260–265 (1993)). Paice et al. in this latter paper, have demonstrated that manganese peroxidase was the active enzyme for oxidation of lignin in kraft pulp. Laccase was only effective in the presence of certain mediators such as ABTS (Bourbonnais and Paice, *Appl. Microbiol. Biotechnol.*, 36:823–827 (1992)). None of these articles describes the beneficial effect on pulp brightness achieved by subsequent treatment with alkaline hydrogen peroxide, which is the subject of the present invention.

In the field of oxidative enzymes in bleaching of kraft pulps, Farrell (U.S. Pat. No. 4,690,895 issued on Sep. 1, 1987) discloses that solutions containing lignin peroxidases can be used to treat kraft pulp and that, following alkaline extraction, the kraft pulp becomes a desired lighter colour. However, no mention is made of manganese peroxidase, nor is the enzyme treatment followed by subsequent treatment with alkaline hydrogen peroxide, as will be described in the present invention. Vaheri and Mikki (European Patent Application EP-A-408,803 published on Jan. 23, 1991) describe a procedure for the bleaching of pulp by sequential treatments with laccase and chlorine-containing chemicals. The procedure produces an effluent with a lower content of chloroorganic compounds but the bleaching of pulp is not significantly enhanced. Olsen et al. (Canadian Patent Application 2,019,411 laid-open on Dec. 22, 1990) claim that wood pulp can be delignified enzymatically in two or more stages including ligninolytic enzymes and xylanase enzymes. Each stage can be followed by alkaline extraction and washing. However, no mention is made of the subsequent treatment with alkaline hydrogen peroxide which surprisingly gives brighter pulp than would be expected from delignification alone, as will be described in the present invention.

Call (German Patent DE-A-3,636,208 issued on May 5, 1988) describes a process for delignifying and bleaching lignocellulose based on the use of lignolytic enzymes. However, manganese peroxidase is not described, and reducing agents such as ascorbic acid are required. In addition, a subsequent alkaline hydrogen peroxide treatment is not described. Similarly, Call (European Patent Application EP-A-447,673 published on Sep. 25, 1991) describes the enzymatic bleaching of celluloses where a redox potential of between 200 and 500 mV is maintained with redox chemicals, and the bleaching is then initiated by the addition of lignolytic enzymes. However, no mention is made of manganese peroxidase and the enzyme reaction is performed in the presence of the complexing agents EDTA or DTPA which inhibit manganese peroxidase. More recently, Call, (International Application WO92/20857 published on Nov. 26, 1992) describes a process for the removal of lignin and the bleaching of lignocellulose with laccase enzymes. However, a simultaneous addition of reducing and oxidizing agents is required. In addition, as with the other articles by Call, no mention is made of the beneficial effect of subsequent alkaline hydrogen peroxide treatment.

Rouvinen, Ruohoniemi and Vaheri (International Application WO92/07998 published on May 14, 1992) describe various enzyme treatments between the bleaching stages but manganese peroxidase or any other oxidative enzyme is not described. Vaheri and Piirainen (International Application WO92/09741 published on Jun. 11, 1992) claim that the oxidizing enzyme laccase can be used in conjunction with manganese ions to reduce the consumption of chlorine chemicals when applied in the later stages of the bleaching. However, no mentioned of either manganese peroxidase or hydrogen peroxide bleaching is made. Eckert (Canadian Patent 1,079,457 issued on Jun. 17, 1980) describes non-enzymatic bleaching of kraft pulp with manganese where manganese(III) ions are generated by oxidation with oxygen. However, large quantities of manganese are required relative to the present invention because the manganese(III) ions cannot be efficiently regenerated in situ, as would be the case with manganese peroxidase.

Arbeloa et al. (European Patent Application EP-A-496, 671 published on Jul. 29, 1992) describe the action of ligninolytic enzymes from *Streptomyces viridosporus* in the bleaching of pulps with oxygen and chlorine dioxide. However, no mention is made of the surprising effect when combined with alkaline hydrogen peroxide, which is the subject of the present invention. Similarly, Arbeloa et al. (*Tappi J.*, 75(3):215–221 (1992)) describe a small kappa decrease when the kraft pulp is treated with lignin peroxidase prior to bleaching with chlorine.

None of the above procedures based on oxidative enzymes describe the combination of the action of the enzyme manganese peroxidase with a subsequent beneficial treatment with alkaline hydrogen peroxide, which gives a surprisingly brighter pulp as described in the present invention.

SUMMARY OF THE INVENTION

One aim of the present invention is to provide for a bleaching process of pulp with enzymes and non-chlorine chemicals which results in environmental friendly bleaching effluents.

Another aim of the present invention is to provide with a brighter pulp.

In accordance with one embodiment of the present invention there is provided a process for the non-chlorine bleaching of kraft pulps, which comprises the steps of:

a) oxidizing the pulp under conditions suitable for the oxidation, with manganese peroxidase enzyme in the presence of hydrogen peroxide and Mn(II) ions, or with laccase enzyme or with a *Trametes versicolor* strain solution;

b) optionally removing metal ions from the oxidized pulp of step a) with a chelator at acid pH, if not already fully removed by step a); and c) treating the pulp of step b) with alkaline hydrogen peroxide to brighten the pulp.

In accordance with a further embodiment of the process of the present invention for the non-chlorine bleaching of kraft pulps, the oxidation step a) is effected at a temperature between 25° and 60° C. for a period between 30 to 240 minutes, the period and temperature being correlated to each other for the complete oxidation of said pulp.

In accordance with a further embodiment of the process of the present invention for the non-chlorine bleaching of kraft pulps, the oxidation step a) is effected using manganese peroxidase enzyme in the presence of hydrogen peroxide, there is added Mn(II), and optionally a chelator selected from the group consisting of lactate, oxalate and malonate, thereby allowing the enzyme to produce an optimum concentration of the chelated form of Mn(III).

In accordance with a further embodiment of the process of the present invention for the non-chlorine bleaching of kraft pulps, the oxidation step a) is effected using laccase enzyme, there is added 2,2'-azinobis(3-ethylbenzothiazoline-6-sulfonic acid (ABTS) or other suitable laccase substrates, thereby providing a suitable mediator for said laccase enzyme.

DETAILED DESCRIPTION OF THE INVENTION

Figure 1:
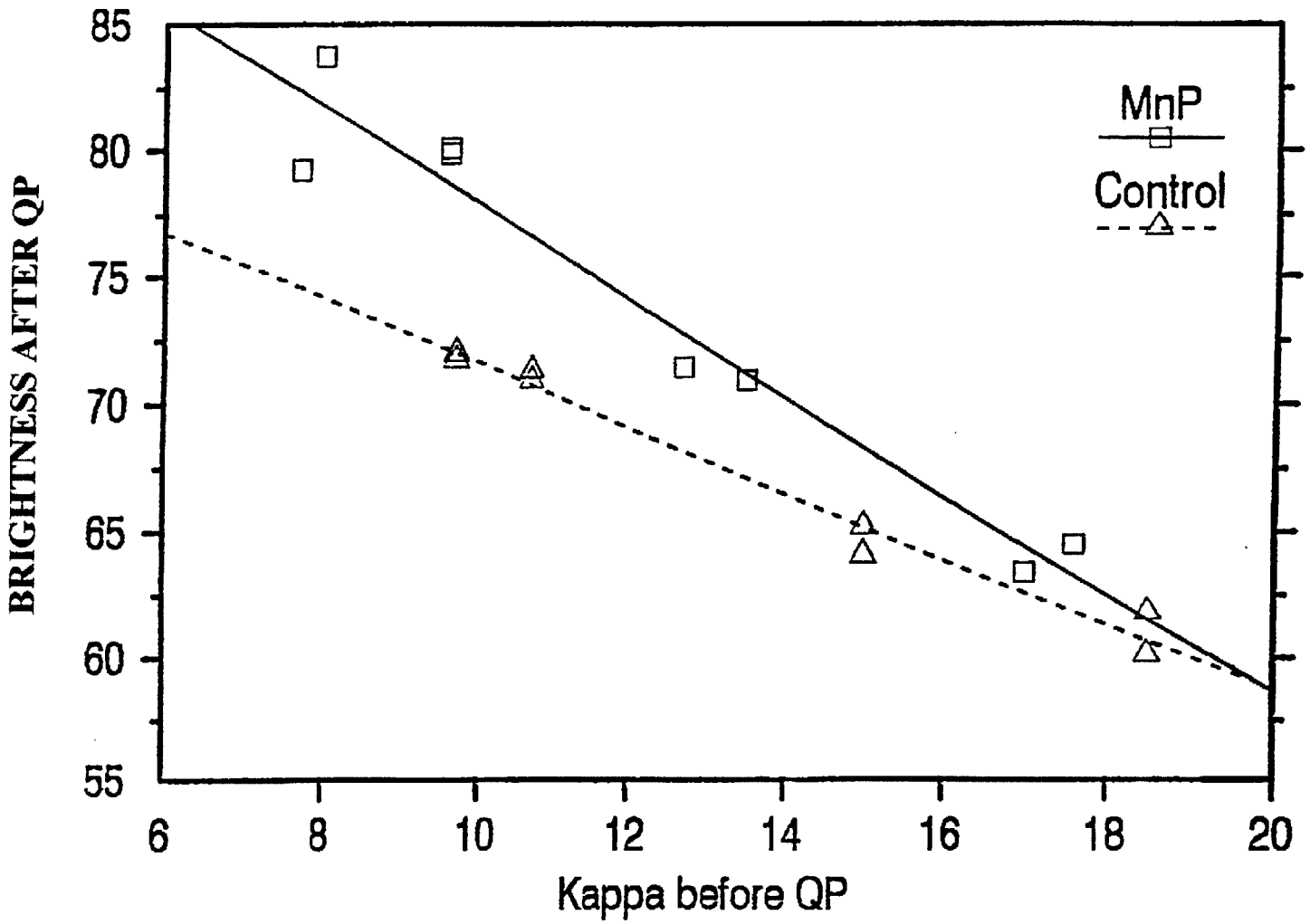
FIG. 1 is a curve of the final brightness of the pulp following chelation (Q) and alkaline hydrogen peroxide (P) treatment relative to the kappa number before QP.

In accordance with the present invention, there is provided a non-chlorine bleaching process for the unexpected brightness increase of kraft pulp. The unexpected brightness increase is essentially effected by delignification of the kraft pulp by either manganese peroxidase or laccase treatment followed by the chelation of metals remaining in the pulp, if any, and an alkaline hydrogen peroxide treatment of the chelated pulp, which results in a brightness over and above that predicted by delignification techniques alone.

When the present invention is practiced, the brightness of the pulp is increased relative to enzyme or alkaline hydrogen peroxide alone, thus less hydrogen peroxide is required to reach a target brightness or a higher brightness plateau can be achieved. Surprisingly, the enzyme-treated pulp of the present invention gives a higher brightness following the peroxide treatment than is predicted from the initial kappa number (FIG. 1). FIG. 1 shows the divergence of brightness compared to that expected from lignin content (kappa number), Wherein the lower line shows the brightness that is predicted by those skilled in the art according to delignification techniques alone. The upper line of FIG. 1 shows the relationship of the brightness of the pulp with hydrogen peroxide treatment after enzyme treatment in accordance with the process of the present invention. This indicates that the effect of the enzyme is not limited to the removal of lignin, as was expected from the literature, but that the remaining lignin is more amenable to brightening by alkaline peroxide.

The progress of the enzyme action can be conveniently followed by monitoring the release of methanol caused by demethylation of the lignin present in the pulp. The enzyme processes are also beneficial for brightness and delignification when preceding an alkaline extraction where peroxide is added (Ep=alkaline extraction with peroxide or Eop= alkaline extraction with oxygen and peroxide).

The pulp used as a reactant in the bleaching process in accordance with the present invention is hardwood or softwood kraft pulp produced by batch or continuous process and including lower-lignin content pulps such as those produced by modified continuous cooking or by oxygen delignification or by xylanase.

The kraft pulp is then washed with water to remove the cooking liquor and to reduce its pH.

The pH of the washed pulp is adjusted to about 3 and 6, either by adding acid such as sulfuric acid or by adding gases such as carbon dioxide or sulfur dioxide. The acidified pulp has a consistency of between 2 and 20% and is mixed with enzymes, either Mn peroxidase with Mn(II), hydrogen peroxide and a chelator, or laccase preferably with ABTS. Hydrogen peroxide can be conveniently generated by the addition of glucose and glucose oxidase, which also generates gluconic acid chelator. The addition of Mn(II) and a chelator is optional and depends on the manganese content of the kraft pulp. In accordance with the present invention, when the manganese content of the kraft pulp is sufficient, the Mn peroxidase can be added as such, without further addition of Mn(II) ions, for the delignification to occur. The pulp is placed in a vessel at a temperature ranging between 25° and 60° C. for a period of time between 30 and 240 minutes.

The amount of enzyme added is specified in units of activity. For manganese peroxidase, one unit of activity is the change in optical density units at 270 nm when the enzyme reacts with manganese (II) in the presence of sodium malonate buffer (50 mM) to form Mn(III) malonate.

With or without further washing of the pulp, EDTA (ethylenediaminetetraacetic acid) or DTPA (diethylenetriaminepentaacetic acid) is added at around pH 5 and allowed to react with the pulp for about 30 minutes. The pulp is then washed with water and alkaline hydrogen peroxide is reacted with the pulp at around 90° C. for between one hour and four hours. The resulting pulp can be further bleached in accordance with any of the well-known conventional bleaching sequences such as further alkaline peroxide steps.

In accordance with the present invention, the term kappa number is intended to mean the lignin content of the pulp measured by oxidation with potassium permanganate.

In accordance with the present invention, the terms Q and P refer to the chelation and alkaline hydrogen peroxide stages of bleaching respectively.

In accordance with the present invention, the brightness is measured by the reflectance at 457 nm and expressed in units of percent reflectance.

In accordance with the present invention, the viscosity is expressed in units of milliPascal.second.

In accordance with the present invention, the term % consistency is intended to mean the weight of pulp (in gram) in 100 g of suspension.

In accordance with the present invention, there may be used, as a suitable chelator, one of the group consisting of lactate, oxalate, malonate and gluconate.

In order to disclose more clearly the nature of the present invention, the following illustrative examples are given.

EXAMPLE I

Mn Peroxidase Treated Pulp With Mn and Malonate

Softwood kraft pulp, kappa 32.0, was delignified with oxygen by a standard procedure with oxygen (100 psi) and sodium hydroxide (2.5%), to give a pulp with kappa number 15.0 and viscosity 23.3. The washed pulp was then mixed continuously at 2% consistency with manganese peroxidase (1 unit/mL) which was isolated by ultrafiltration from the fungus *Trametes versicolor* grown for 7 days in a culture broth containing glucose (40 g/liter), SOYTONE™ (enzymatic digest of soybean meal, Difco) (10 g/liter) and MnSO4 (0.2 mM).

The *Trametes versicolor* strain was deposited at the American Type Culture Collection under ATCC accession number 20869 on Oct. 28, 1987 (ATCC, 12301 Parklawn Drive, Rockville, Md. 20852 USA). This deposit is available to be public upon the grant of a patent to the assignee, Pulp and Paper Research Institute of Canada, disclosing same. The *Trametes versicolor* strain produces under certain culture conditions, laccase as described by Bourbonnais and Paice (*Appl. Microbiol. Biotechnol.*, 36:823–827 (1992)) and manganese peroxidase as described by Paice et al. (*Appl. Environment. Microbiol.*, 59:260–265 (1993)).

Manganese (II) sulfate (0.5 mM), sodium malonate buffer (50 mM, pH 4.5), glucose (10 mM) and the enzyme glucose oxidase (0.025 units/mL) were also added. The glucose and glucose oxidase generated a constant low level of hydrogen peroxide, as required by the manganese peroxidase. The pulp was reacted at 25° C. for 24 h during which time methanol was continuously generated in the solution. Without hydrogen peroxide there was no reaction, which demontrates that manganese peroxidase, and not laccase, was the active enzyme.

The enzyme-treated pulp was washed and then reacted at 2% consistency with EDTA (abbreviated Q) at dosage of 0.6% on pulp and pH 5.5, at a temperature of 50° C. for 2 h. The pulp was washed again and then treated at 10% consistency for 2 hours at 90° C. with a solution containing hydrogen peroxide (abbreviated P) (2.5%), sodium hydroxide (various concentrations), $MgSO_4$ (0.25%) and DTPA (0.2%). Following this step, the pulp was soured to pH 5 with $SO_2$, washed and made into handsheets. The brightness and kappa number were compared to controls which were treated identically but without manganese peroxidase or manganese addition (Table I).

The resulting pulp in accordance with the present invention has a higher brightness than the control pulp.

TABLE I

| | Control | | | Manganese Peroxidase Added | | |
|---|---|---|---|---|---|---|
| NaOH added | 1.5 | 2.0 | 2.5 | 1.5 | 2.0 | 2.5 |
| Brightness, % ISO | 69.4 | 70.7 | 71.8 | 77.3 | 78.4 | 79.0 |
| Kappa after QP | 8.3 | 8.1 | 8.5 | 5.7 | 5.6 | 5.2 |
| Viscosity, mPa.s | 22.8 | 21.4 | 20.7 | 20.6 | 19.5 | 20.9 |

EXAMPLE II

Mn Peroxidase Treated Pulp Without Mn and Malonate

The procedure as conducted for Example I, except that the addition of manganese and sodium malonate were omitted. The pH of the pulp for the enzyme stage was adjusted by the addition of sulfuric acid. Sufficient Mn(II) ions was already present in the pulp, and gluconate chelator was provided by the action of glucose oxidase on glucose.

The experiment was performed in triplicate with a constant NaOH concentration of 2.5% in the P stage. The results are shown in Table II. The brightness obtained with manganese peroxidase is considerably higher than predicted from the kappa number before QP, as illustrated in FIG. 1. Thus the brightening effect of the enzyme is not caused simply by lignin removal.

TABLE II

| | Control | | | Manganese Peroxidase Added | | |
|---|---|---|---|---|---|---|
| Brightness | 72.7 | 72.0 | 73.2 | 77.8 | 78.5 | 79.2 |
| Kappa after QP | 8.2 | 8.4 | 8.2 | 6.1 | 6.4 | 6.5 |
| Viscosity, mPa.s | 19.8 | 18.4 | 19.7 | 17.8 | 18.2 | 18.6 |

EXAMPLE III

Mn Peroxidase Treated Pulp With Mn and Malonate

Hardwood kraft pulp (kappa number 14) from an Eastern Canadian mill was mixed continuously at 2% consistency with an enzyme solution from the fungus *Trametes versicolor*, containing 0.43 units/mL of manganese peroxidase enzyme activity. Manganese (II) sulfate, (0.5 mM), sodium malonate (50 mM), glucose (10 mM) and the enzyme glucose oxidase (0.025 units/mL) were also added. The glucose and glucose oxidase generated a constant level of hydrogen peroxide. The pulp was reacted at 25° C., pH 4.5, for either 4 h or 24 h, during which time methanol was continuously generated in solution.

The enzyme-treated pulp was washed and then was reacted with EDTA. (abbreviated Q) (0.2% on pulp at pH 5, consistency 10% for 30 min. The pulp was washed again and then treated at 10% consistency at 90° C. for 2 hours with a solution containing hydrogen peroxide (abbreviated P) (2%), sodium hydroxide (3%), ($MgSO_4$ (0.05%)) and DTPA (0.12%). All percentages are on dry weight of pulp. The pulp was soured with $SO_2$, washed and made into handsheets. The brightness and kappa number was compared to controls which were treated identically but without Mn peroxidase addition (Table III).

The brightness of the Mn peroxidase treated pulp in accordance with the present invention is higher than the control and increases with the period of time of the reaction.

TABLE III

| | Control | Mn-peroxidase 4 h | Mn-peroxidase 24 h |
|---|---|---|---|
| Kappa before QP | 13.6 | 12.1 | 11.7 |
| Kappa after QP | 9.0 | 8.2 | 6.5 |
| Brightness after QP | 55.8 | 58.5 | 63.1 |

EXAMPLE IV

Non-delignified Pulp Treated with Mn Peroxidase, Mn and Malonate

The procedure as conducted for Example I, except that a black spruce pulp of kappa number 30 was used without oxygen delignification. The results are shown in Table IV.

The brightness of the Mn peroxidase treated pulp in accordance with the present invention is higher than the control. This demonstrates that the process of the present invention removes the lignin present in the raw pulp. Again the brightness of the Mn peroxidase treated pulp in accordance with the present invention increases with the period of time of the reaction.

TABLE IV

| | Control | Mn peroxidase 4h | Mn peroxidase 24 h |
|---|---|---|---|
| Kappa after QP | 22.0 | 18.6 | 16.5 |
| Brightness | 46.0 | 51.2 | 52.2 |

EXAMPLE V

The Effect of Enzyme Treatment on the Extracted Kappa Number

Black spruce pulp was first treated with manganese peroxidase under the conditions described in the enzyme step of Example I. The pulp was then extracted with alkali, either with or without addition of peroxide. The conditions of alkaline extraction were similar to those employed in an Ep-stage, namely 3% NaOH on pulp, 0.05% $MgSO_4$, 0.2% DTPA and hydrogen peroxide as specified. The pulp was reacted at 90° C. for 2 h and then washed with water. Table V shows that the peroxide effect on kappa reduction is enhanced by the enzyme pretreatment, when compared to controls where manganese peroxidase was not added.

TABLE V

| | Control | Manganese peroxidase added | Difference |
|---|---|---|---|
| Kappa before alkaline extraction | 28.7 | 25.8 | 2.9 |
| Kappa after alkaline extraction (E) | 26.4 | 24.0 | 2.4 |
| Kappa after alkaline extraction with 0.5% $H_2O_2$ ($E_p$) | 24.3 | 21.1 | 3.2 |
| Kappa after alkaline extraction with 2.5% $H_2O_2$ ($E_p$) | 21.5 ± 0.2 | 15.7 ± 0.7 | 6.8 |

EXAMPLE VI

Mn Peroxidase Treated Pulp With Glucose and Glucose Oxidase

The reaction time with manganese peroxidase can be decreased by adding more glucose and glucose oxidase. Thus, the data in Table VI were generated using the reaction conditions from Example I, except that the manganese peroxidase reaction time was 4 h, and was effected with the addition of glucose (60 mM) and glucose oxidase (0.15 U/mL). Controls were identical except that manganese peroxidase was not added.

The peroxide effect on kappa reduction is enhanced by the enzyme pretreatment, when compared to controls where manganese peroxidase was not added.

The brightness of the Mn peroxidase treated pulp in accordance with the present invention is higher than the control.

TABLE VI

| | Control | | Manganese Peroxidase Added | |
|---|---|---|---|---|
| Brightness | 61.5 | 62.4 | 72.1 | 71.5 |
| Kappa | 9.7 | 8.3 | 6.1 | 6.0 |

EXAMPLE VII

Laccase Treated Pulp With and Without ABTS

Hardwood kraft pulp at 2% consistency was reacted with laccase enzyme in the presence of air at pH 5.0 (pH controlled with sodium acetate buffer). Optionally, ABTS (2.7% on pulp) was added to increase the effectiveness of the enzyme. The reaction mixture was agitated for 5 days at 25° C.

The enzyme-treated pulp was washed with water and then treated with Q and P stages as in Example I. Control pulp was run identically but without laccase. Enzyme-treated pulps have lower lignin content and higher brightness as shown in Table VII.

TABLE VII

| | Control | Laccase | Laccase + ABTS |
|---|---|---|---|
| Kappa after QP | 8.3 | 8.5 | 5.1 |
| Brightness | 58.4 | 61.2 | 63.1 |

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

We claim:

1. A process for the non-chlorine bleaching of kraft pulps, which comprises the steps of:

a) oxidizing the pulp at an acid pH and at a temperature between 25 degree C. and 60 degree C. for a period of time between 30 to 240 minutes with suitable amounts of manganese peroxidase enzyme, hydrogen peroxide and Mn(II) ions, or with laccase enzyme or with *Trametes versicolor* ATCC 20869 strain solution;

b) removing metal ions from the oxidized pulp of step a) with a chelator selected from the group consisting of EDTA(ethylenediaminetetraacetic acid), DTPA (diethylenetriaminepentaacetic aicd), lactate, oxalate and malonate at acid pH; and c) treating the pulp of step b) with alkaline hydrogen peroxide in an amount and under conditions effective to brighten the pulp.

2. The process according to claim 1, wherein step a) is effected using manganese peroxidase enzyme in the presence of hydrogen peroxide, and comprises the addition of Mn(II) and said chelator, thereby allowing the enzyme to produce an optimum concentration of a chelated form of Mn(III) for bleaching of kraft pulp.

3. The process according to claim 1, wherein step a) is effected using the manganese peroxidase enzyme in the presence of glucose oxidase and glucose, thereby generating a constant level of hydrogen peroxide during enzymatic bleaching of the pulp.

4. The process according to claim 1, wherein step a) is effected using the laccase enzyme, and further comprises the addition of ABTS (azinobis-3-ethylbenzothiazoline-6-sulfonic acid) or other suitable laccase substrates, thereby providing a suitable mediator for said laccase enzyme.

* * * * *